US010334681B2

(12) United States Patent
Yoon et al.

(10) Patent No.: US 10,334,681 B2
(45) Date of Patent: Jun. 25, 2019

(54) DEVICE FOR DRIVING LIGHT EMITTING ELEMENT

(71) Applicant: LG INNOTEK CO., LTD., Seoul (KR)

(72) Inventors: Jae Hun Yoon, Seoul (KR); Do Yub Kim, Seoul (KR); Min Hak Kim, Seoul (KR); Seung Beom Jeong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/535,537

(22) PCT Filed: Nov. 5, 2015

(86) PCT No.: PCT/KR2015/011819
§ 371 (c)(1),
(2) Date: Jun. 13, 2017

(87) PCT Pub. No.: WO2016/104940
PCT Pub. Date: Jun. 30, 2016

(65) Prior Publication Data

US 2017/0332453 A1 Nov. 16, 2017

(30) Foreign Application Priority Data

Dec. 22, 2014 (KR) ..... 10-2014-0185732

(51) Int. Cl.
*H05B 33/08* (2006.01)
*H05B 37/02* (2006.01)

(52) U.S. Cl.
CPC ..... *H05B 33/0851* (2013.01); *H05B 33/0809* (2013.01); *H05B 33/0887* (2013.01); *H05B 37/02* (2013.01)

(58) Field of Classification Search
CPC ..... H05B 33/0815; H05B 33/0809; H05B 33/0845; H05B 33/0851; H05B 33/0848; H05B 37/02; Y02B 20/346; Y10S 323/905
(Continued)

(56) References Cited

U.S. PATENT DOCUMENTS 6,222,746 B1 * 4/2001 Kim ..... H02M 1/4225 323/222
9,258,855 B1 * 2/2016 Mart ..... H05B 33/0803
(Continued)

FOREIGN PATENT DOCUMENTS

CN 103687245 A 3/2014
CN 103841734 A 6/2014
(Continued)

*Primary Examiner* — Crystal L Hammond
(74) *Attorney, Agent, or Firm* — Birch, Stewart, Kolasch & Birch, LLP

(57) ABSTRACT

An embodiment comprises: a voltage generation unit for providing a direct current signal for driving a light emitting unit; a sensing resistor; and a dimming unit which is connected between the light emitting unit and the sensing resistor and controls a current flowing in the sensing resistor and the light emitting unit, wherein the dimming unit adjusts the level of the direct current signal on the basis of a first sensing voltage as a result of sensing the voltage of a first node where a switch is connected to the light emitting unit, and a second sensing voltage as a result of sensing the voltage of a second node where the switch is connected to the sensing resistor.

20 Claims, 5 Drawing Sheets

(58) Field of Classification Search
USPC ..... 315/200 R, 291, 307, 209 R, 224, 246, 315/247; 323/905; 327/531
See application file for complete search history.

(56) References Cited

U.S. PATENT DOCUMENTS

| | | | | |
|---|---|---|---|---|
| 2009/0295776 | A1 | 12/2009 | Yu et al. | |
| 2009/0322252 | A1* | 12/2009 | Shiu | H03K 17/08142 315/297 |
| 2010/0090540 | A1* | 4/2010 | Tanaka | G01R 31/3658 307/115 |
| 2010/0164404 | A1 | 7/2010 | Shao et al. | |
| 2010/0219766 | A1* | 9/2010 | Kuo | H05B 33/0818 315/224 |
| 2011/0001439 | A1 | 1/2011 | Cecconello et al. | |
| 2011/0157246 | A1* | 6/2011 | Jang | G09G 3/3406 345/690 |
| 2011/0181199 | A1* | 7/2011 | Lin | H05B 33/0818 315/291 |
| 2012/0146530 | A1* | 6/2012 | Han | H05B 33/0815 315/219 |
| 2012/0169641 | A1* | 7/2012 | Wang | G06F 3/0418 345/173 |
| 2012/0206054 | A1 | 8/2012 | Kim | |
| 2013/0154488 | A1* | 6/2013 | Sadwick | H05B 37/02 315/172 |
| 2013/0154496 | A1* | 6/2013 | Maru | H02M 1/44 315/210 |
| 2013/0250215 | A1 | 9/2013 | Sasaki et al. | |
| 2013/0293109 | A1* | 11/2013 | Cheon | H05B 33/0887 315/122 |
| 2013/0313974 | A1 | 11/2013 | Fan et al. | |
| 2014/0152183 | A1 | 6/2014 | Kim et al. | |
| 2014/0159608 | A1* | 6/2014 | Simi | H05B 33/0887 315/205 |
| 2014/0225532 | A1* | 8/2014 | Groeneveld | H02M 3/33507 315/307 |

FOREIGN PATENT DOCUMENTS

| | | | |
|---|---|---|---|
| CN | 104168697 | A | 11/2014 |
| JP | 2013-502689 | A | 1/2013 |
| JP | 2014-110244 | A | 6/2014 |
| KR | 10-2010-0066267 | A | 6/2010 |
| KR | 10-0968979 BI | | 7/2010 |
| KR | 10-1018171 | B1 | 2/2011 |
| TW | 200950589 | A | 12/2009 |

* cited by examiner

DEVICE FOR DRIVING LIGHT EMITTING ELEMENT

CROSS REFERENCE TO RELATED APPLICATIONS

This application is the National Phase of PCT International Application No. PCT/KR2015/011819, filed on Nov. 5, 2015, which claims priority under 35 U.S.C. 119(a) to Patent Application No. 10-2014-0185732, filed in the Republic of Korea on Dec. 22, 2014, all of which are hereby expressly incorporated by reference into the present application.

TECHNICAL FIELD

Embodiments relate to a device for driving a light emitting element.

BACKGROUND ART

Recently, an LED light having high luminance, comparable to that of a lighting device such as an incandescent lamp, while being driven with low power has attracted increasing attention. Particularly, light driving devices for driving the LED light by controlling uniform current to flow through the LED light are actively researched and developed.

Such a light driving device has various lighting functions and, particularly, can enable lighting in various forms by changing dimming levels of LED elements arranged in serial/parallel connection.

In general, a light driving device can include a rectification circuit for rectifying full waves output from an AC power supply, a transformation circuit for transforming the voltage output from the rectification circuit and outputting the transformed voltage, a power factor correction circuit for correcting a power factor of power output from the AC power supply by controlling the output voltage of the transformation circuit, a smoothing circuit for smoothing the voltage output from the transformation circuit to output a stable DC voltage and supplying the output voltage to an LED module, a constant current driving circuit for controlling LED current such that uniform driving current flows through the LED module, and a dimming control circuit for controlling current flow in the LED module by controlling the constant current driving circuit according to PWM (Pulse Width Modulation), thereby controlling dimming.

DISCLOSURE

Technical Problem

Embodiments provide a device for driving a light emitting element which can improve power efficiency and prevent flickering.

Technical Solution

A device for driving a light-emitting element according to an embodiment includes: a voltage generator for providing a DC signal for driving a light-emitting unit; a sensing resistor; and a dimming unit connected between the light-emitting unit and the sensing resistor and controlling current flowing through the sensing resistor and the light-emitting unit, wherein the dimming unit adjusts a level of the DC signal on the basis of a first sensing voltage according to a result obtained by sensing a voltage of a first node at which the light-emitting unit and a switch are connected and a second sensing voltage according to a result obtained by sensing a voltage of a second node at which the switch and the sensing resistor are connected.

The dimming unit may adjust the level of the DC signal such that a difference between the first sensing voltage and the second sensing voltage becomes equal to or lower than a first reference voltage.

The dimming unit may block current flow between the light-emitting unit and the sensing resistor when the difference between the first sensing voltage and the second sensing voltage exceeds a second reference voltage.

The dimming unit may include: a switch connected between the light-emitting unit and the sensing resistor; an amplifier including a first input terminal receiving a constant-current control signal, a second input terminal connected to the second node, and an output terminal; a voltage sensing unit outputting the first sensing voltage and the second sensing voltage; and a controller for generating a dimming signal on the basis of the first and second sensing voltages, wherein the switch is switched in response to output of the amplifier and the voltage generator adjusts the level of the DC signal on the basis of the dimming signal.

The constant-current control signal may be an analog signal.

The dimming unit may smooth a pulse width modulation signal and provide a signal according to a smoothing result as the constant-current control signal.

The controller may adjust the level of the DC signal such that the difference between the first sensing voltage and the second sensing voltage becomes equal to or lower than the first reference voltage.

The switch may be implemented as a transistor and the first reference voltage may be a drain-source on state voltage of the switch.

The controller may decrease the level of the DC signal when the difference between the first sensing voltage and the second sensing voltage exceeds the first reference voltage and is equal to or lower than the second reference voltage.

The controller may change a level of the constant-current control signal to zero when the difference between the first sensing voltage and the second sensing voltage exceeds the second reference voltage.

The device for driving a light-emitting element may further include: a rectifier for rectifying an AC signal and providing a rectified signal according to the rectification result; and a power factor correction unit for correcting a power factor of the rectified signal and outputting the power-factor-corrected rectified signal to the voltage generator.

The controller may calculate sensing current flowing through the sensing resistor on the basis of the second sensing voltage and turn on or off the power factor correction unit on the basis of the calculated sensing current.

The controller may turn off the power factor correction unit when the sensing current is lower than a reference current value.

A device for driving a light-emitting element according to another embodiment includes: a voltage generator for providing a DC signal for driving a light-emitting unit on the basis of a dimming signal; an amplifier including a first input terminal receiving a constant-current control signal, a second input terminal and an output terminal; a sensing resistor, one terminal of which is connected to the second input terminal; a switch connected between the light-emitting unit and the sensing resistor and switched in response to an output of the amplifier; a voltage sensing unit outputting a first sensing voltage according to a result obtained by sensing a voltage of a first node at which the light-emitting unit and the switch are connected and a second sensing voltage according to a result obtained by sensing a voltage of a second node at which the switch and one terminal of the sensing resistor are connected; and a controller for providing the dimming signal for adjusting the level of the DC signal on the basis of a difference between the first sensing voltage and the second sensing voltage to the voltage generator.

The device for driving a light-emitting element may further include a smoothing circuit for smoothing a pulse width modulation signal and providing a signal according to the smoothing result as the constant-current control signal.

The controller may provide the pulse width modulation signal.

The device for driving a light-emitting element may further include: a rectifier for rectifying an AC signal and providing a rectified signal according to the rectification result; and a power factor correction unit for correcting a power factor of the rectified signal and outputting the power-factor-corrected rectified signal to the voltage generator.

The voltage generator may change the level of the power-factor-corrected rectified signal on the basis of the dimming signal and generate the DC signal according to the level change result.

The controller may calculate sensing current flowing through the sensing resistor on the basis of the second sensing voltage and turn on or off the power factor correction unit on the basis of the calculated sensing current.

A device for driving a light-emitting element according to another embodiment includes: a voltage generator for providing a DC signal for driving a plurality of light-emitting units; a plurality of sensing resistors; a plurality of dimming units for controlling current flowing through the plurality of light-emitting units; and a controller for providing a constant-current control signal to each of the plurality of dimming units and adjusting the level of the DC signal, wherein each of the plurality of dimming units includes: an amplifier including a first input terminal receiving the constant-current control signal, a second input terminal connected to a corresponding one of the plurality of sensing resistors, and an output terminal; a switch connected between a corresponding one of the plurality of light-emitting units and one terminal of a corresponding one of the plurality of sensing resistors and switched in response to an output of the amplifier; and a voltage sensing unit outputting first sensing voltages according to results obtained by sensing a voltage of a first node at which a corresponding one of the plurality of light-emitting units and the switch are connected and second sensing voltages according to results obtained by sensing a voltage of a second node at which the switch and one terminal of a corresponding one of the plurality of sensing resistors are connected, wherein the controller adjusts the level of the DC signal on the basis of differences between the first sensing voltages and the second sensing voltages.

Advantageous Effects

Embodiments can improve power efficiency and prevent flickering.

BEST MODE

Figure 1:
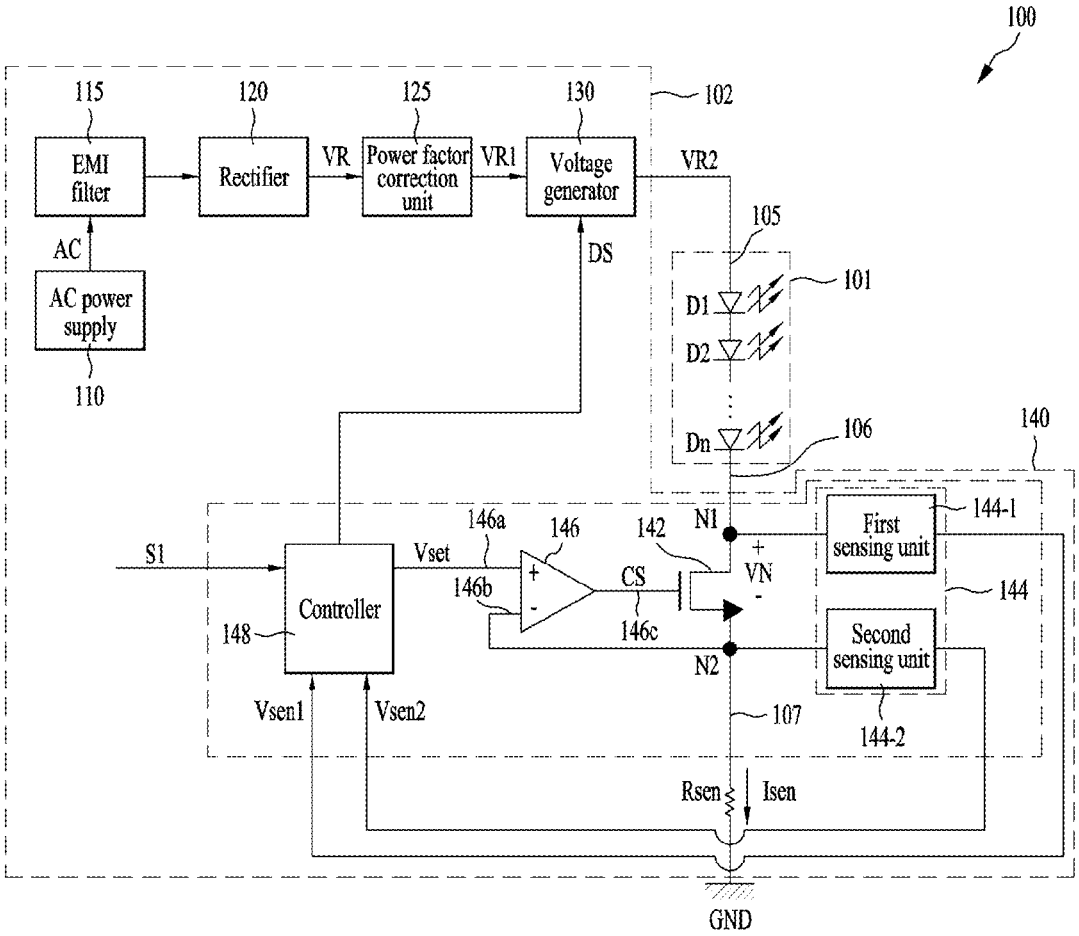
FIG. 1 illustrates a configuration of a lighting apparatus according to an embodiment.

Reference will now be made in detail to the exemplary embodiments, examples of which are illustrated in the accompanying drawings. In description of embodiments, it will be understood that when a layer (film), region, pattern or structure is referred to as being "above"/"on" or "below"/"under" another layer (film), region, pattern or structure, it can be directly "above"/"on" the other layer (film), region, pattern or structure or an intervening element may be present therebetween. Furthermore, relative terms, such as "lower"/"bottom" and "upper"/"top" may be used herein to describe one element's relationship to another elements as illustrated in the Figures.

In the drawings, dimensions of layers are exaggerated, omitted or schematically illustrated for clarity and convenience of description. In addition, dimensions of constituent elements do not entirely reflect actual dimensions thereof. The same reference numbers will be used throughout the drawings to refer to the same or like parts.

FIG. 1 illustrates a configuration of a lighting apparatus 100 according to an embodiment.

Referring to FIG. 1, the lighting apparatus 100 includes a light-emitting unit 101 and a light-emitting element driving device 102 for driving the light-emitting unit 101.

The light-emitting unit 101 includes a plurality of light-emitting element arrays D1 to Dn (n being a natural number greater than 1) connected in series.

Each of the light-emitting element arrays D1 to Dn (n being a natural number greater than 1) may include one or more light-emitting elements, for example, light-emitting diodes.

When a plurality of light-emitting elements is included in a light-emitting element array, the light-emitting elements may be connected in series, in parallel or in series and parallel.

The light-emitting element driving device 102 includes an AC power supply 110, an EMI filter 115, a rectifier 120, a power factor correction unit 125, a power generator 130, a dimming unit 140 and a sensing resistor Rsen.

The AC power supply unit 110 provides an AC signal.

For example, the AC signal AC may be an AC voltage and/or AC current.

The EMI (Electromagnetic Interference) filter 115 filters external electromagnetic noise and removes noise included in the AC signal AC supplied from the AC power supply 110, for example, conductive noise. The EMI filter 115 may be implemented to include at least one of a capacitor, a transformer and an inductor.

The rectifier 120 rectifies the AC signal AC from which the electromagnetic noise has been removed by the EMI filter 115 and provides a rectified signal (ripple current) VR according to the rectification result.

For example, the rectifier 120 may full-wave rectify the AC signal AC and output the rectified signal VR according to the full-wave rectification result. That is, the rectified signal VR may be a signal obtained by full-wave rectifying the AC signal AC.

While the rectifier 120 may be implemented as a full-wave diode bridge circuit including four bridge-connected diodes, the rectifier 120 is not limited thereto.

The power factor correction unit 125 adjusts phase differences of the voltage and current of the rectified signal VR to correct the power factor of the rectified signal VR and outputs a power-factor-corrected rectified signal VR1.

The voltage generator 130 changes the level of the rectified signal VR1 having the power factor corrected by the power factor correction unit 125 on the basis of a dimming signal DS provided by the dimming unit 140 and outputs a level-changed DC signal VR2. For example, the DC signal VR2 may be a DC voltage.

Here, the level of the DC signal VR2 output from the voltage generator 130 may be set or changed on the basis of the dimming signal DS provided by the dimming unit 140.

The DC signal VR2 output from the voltage generator 130 is provided to the light-emitting unit 101. For example, the DC signal VR2 output from the voltage generator 130 can be provided to an input terminal 105 of the light-emitting unit 101. Here, the input terminal 105 of the light-emitting unit 101 may be a positive terminal of the first light-emitting element array D1 of the serially connected light-emitting element arrays D1 to Dn.

The voltage generator 130 may be implemented as a converter that can change the DC level of the rectified signal VR1. For example, the voltage generator 130 may be implemented to include at least one of a DC-DC converter, a resonant LLC half bridge converter, a fly back converter, and a buck converter.

The dimming unit 140 connects the light-emitting unit 101 and the sensing resistor Rsen and adjusts the luminance of the light-emitting unit 101 by controlling current flowing through the light-emitting unit 101.

Further, the dimming unit 140 changes the level of the DC signal VR2 supplied from the voltage generator 130 such that a voltage VN between an output terminal 106 of the light-emitting unit 101 and one terminal 107 of the sensing resistor Rsen is maintained at a predetermined reference voltage.

Here, the output terminal 106 of the light-emitting unit 101 may be a negative terminal of the last light-emitting element array Dn of the serially connected light-emitting element arrays D1 to Dn. The predetermined reference voltage will be described with reference to FIG. 5.

The dimming unit 140 may adjust the level of the DC signal VR2 on the basis of a first sensing voltage Vsen1 obtained by sensing a voltage of a first node N1 at which the light-emitting unit 101 and a switch 142 are connected and a second sensing voltage Vsen2 obtained by sensing a voltage of a second node N2 at which the switch 142 and the sensing resistor Rsen are connected.

For example, the dimming unit 140 can generate the dimming signal DS on the basis of the first sensing voltage Vsen1 obtained by sensing the voltage of the first node N1 at which the light-emitting unit 101 and the switch 142 are connected and the second sensing voltage Vsen2 obtained by sensing the voltage of the second node N2 at which the switch 142 and the sensing resistor Rsen are connected.

The dimming unit 140 may adjust the level of the DC signal VR2 such that the difference Vsen1-Vsen2 between the first sensing voltage Vsen1 and the second sensing voltage Vsen2 is equal to or lower than a first reference voltage.

Further, the dimming unit 140 may block current flow between the light-emitting unit 101 and the sensing resistor Rsen when the difference Vsen1-Vsen2 between the first sensing voltage Vsen1 and the second sensing voltage Vsen2 exceeds a second reference voltage. For example, the dimming unit 140 can decrease the level of the DC signal VR2 to a level that is insufficient to turn on the light-emitting unit 101 or control the voltage generator 130 to change the level of the DC signal VR2 to zero when the difference Vsen1-Vsen2 between the first sensing voltage Vsen1 and the second sensing voltage Vsen2 exceeds the second reference voltage.

The dimming unit 140 may include the switch 142, a voltage sensing unit 144, an amplifier 146 and a controller 148.

The switch 142 is connected between the output terminal 106 of the light-emitting unit 101 and one terminal 107 of the sensing resistor Rsen and is switched on the basis of a constant-current control signal Vset supplied from the controller 148.

For example, the switch 142 can be implemented as a transistor, for example, an FET or a BJT.

For example, the switch 142 can be implemented as an NMOS transistor including a drain connected to the output terminal 106 of the light-emitting unit 101, a source connected to one terminal 107 of the sensing resistor Rsen and a gate to which the output of the amplifier 146 is input. However, the switch 142 is not limited thereto and may be implemented as a PMOS transistor in other embodiments.

The switch 142 may be implemented in various forms that electrically connect the output terminal 106 of the light-emitting unit 101 and one terminal 107 of the sensing resistor Rsen in response to the output CS of the amplifier 146.

The voltage VN between the output terminal 106 of the light-emitting unit 101 and one terminal 107 of the sensing resistor Rsen may be a voltage between the source and drain of the switch 142 implemented as a transistor.

The voltage sensing unit 144 may sense the voltage of the first node N1 at which the output terminal 106 of the light-emitting unit 101 and the switch 142 are connected and the voltage of the second node N2 at which one terminal 107 of the sensing resistor Rsen and the switch 142 are connected.

For example, the voltage sensing unit 144 can sense the voltage of the first node N1 and provide the first sensing voltage Vsen1 to the controller 148 according to the sensing result.

In addition, the voltage sensing unit 144 can sense the voltage of the second node N2 and provide the second sensing voltage Vsen2 to the controller 148 according to the sensing result.

The voltage sensing unit 144 may include a first sensing unit 144-1 for sensing the voltage of the first node N1 and providing the first sensing voltage Vsen1 and a second sensing unit 144-2 for sensing the voltage of the second node N2 and providing the second sensing voltage Vsen2.

Figure 2A:
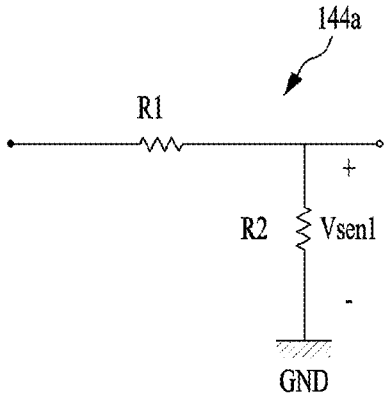
FIG. 2*a* illustrates an embodiment of a first sensing unit shown in FIG. 1.

FIG. 2*a* illustrates an embodiment 144*a* of the first sensing unit 144-1 shown in FIG. 1.

Referring to FIG. 2*a*, the first sensing unit 144*a* may include a plurality of resistors (e.g., R1 and R2) serially connected between the first node N1 and a ground power supply GND and may provide a voltage applied to at least one of the plurality of resistors (e.g., R1 and R2) to the controller 148 as the first sensing voltage Vsen1.

Figure 2B:
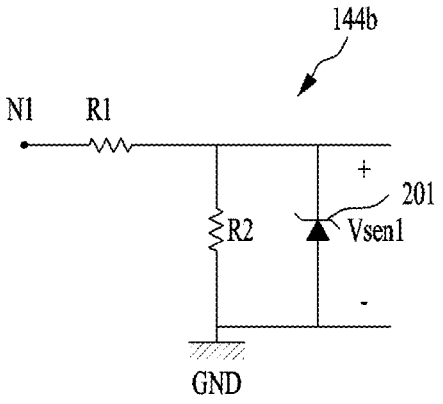
FIG. 2*b* illustrates another embodiment of the first sensing unit shown in FIG. 1.

FIG. 2*b* illustrates another embodiment 144*b* of the first sensing unit 144-1 shown in FIG. 1.

Referring to FIG. 2*b*, the first sensing unit 144*b* may include a plurality of resistors (e.g., R1 and R2) serially connected between the first node N1 and the ground power supply GND and a Zener diode 201 connected in parallel with at least one (e.g., R2) of the plurality of resistors (e.g., R1 and R2) and provide a voltage applied across the Zener diode 201 to the controller 148 as the first sensing voltage Vsen1.

For example, the first sensing unit 144*b* can include first and second resistors R1 and R2 serially connected between the first node N1 and the ground power supply GND and the Zener diode 201 connected between a connecting node of the first and second resistors R1 and R2 and the ground power supply GND and provide the voltage applied across the Zener diode 201 to the controller 148 as the first sensing voltage Vsen1.

The second sensing unit 144-2 may provide the voltage applied to the second node N2 to the controller 148 as the second sensing voltage Vsen2.

For example, the second sensing unit 144-2 can sense the voltage applied to the sensing resistor Rsen and provide the voltage applied to the sensing resistor Rsen to the controller 148.

The embodiments illustrated in FIGS. 2*a* and 2*b* may be applied to the second sensing unit 144-2 in other embodiments. However, values of resistors included in the second sensing unit 144-2 may differ from those of the first sensing unit 144-1.

The amplifier 146 amplifies the constant-current control signal Vset supplied from the controller 148 and the voltage of the second node N2 and outputs an amplified signal CS according to the amplification result. For example, the constant-current control signal Vset supplied from the controller 148 shown in FIG. 1 may be an analog signal such as a DC voltage instead of a pulse signal such as a PWM signal.

The amplifier 146 may include a first input terminal 146*a* to which the constant-current control signal Vset is input, a second input terminal 146*b* connected to the second node N2 and an output terminal 146*c* through which the amplified signal CS is output. While the amplifier 146 may be implemented as an operational amplifier or a differential amplifier, the amplifier 146 is not limited thereto. For example, the first input terminal 146*a* may be a positive input terminal (+) of an operational amplifier and the second input terminal 146*b* may be a negative input terminal (−) of the operational amplifier.

Current flowing through the sensing resistor Rsen may be determined by the constant-current control signal Vset provided by the controller 148, and thus current flowing through the light-emitting unit 101 can be controlled in the present embodiment. According to characteristics of the operational amplifier, the voltage of the second node N2 is the constant-current control signal Vset input to the first input terminal 146*a* and thus sensing current Isen flowing through the sensing resistor Rsen may be obtained by dividing the constant-current control signal Vset by the value of the sensing resistor Rsen.

Since the constant-current control signal Vset is not a pulse signal but is an analog signal, the current flowing through the light-emitting unit 101 can be linear unless the level of the constant-current control signal Vset is changed by the light-emitting unit 101 and thus flickering of the light-emitting unit 101 can be reduced or eliminated.

The controller 148 may control the voltage generator 130 to change the level of the DC signal VR2 output from the voltage generator 130 on the basis of the first sensing voltage Vsen1 and the second sensing voltage Vsen2 supplied from the voltage sensing unit 144.

For example, the controller 148 can generate the dimming signal DS for controlling the voltage generator 130 on the basis of the first sensing voltage Vsen1 and the second sensing voltage Vsen2, and the voltage generator 130 can change the level of the rectified signal VR1 on the basis of the dimming signal DS and output the level-changed DC signal VR2. That is, the level of the DC signal VR2 supplied from the voltage generator 130 to the light-emitting unit 101 can be determined on the basis of the dimming signal DS.

The controller 148 may adjust the level of the DC signal VR2 of the voltage generator 130 such that the difference Vsen1-Vsen2 between the first sensing voltage Vsen1 and the second sensing voltage Vsen2 becomes equal to or lower than a predetermined reference voltage.

For example, the controller 148 can adjust the level of the DC signal VR2 of the voltage generator 130 such that the difference Vsen1-Vsen2 between the first sensing voltage Vsen1 and the second sensing voltage Vsen2 becomes equal to a predetermined first reference voltage.

For example, the predetermined first reference voltage can be a drain-source on state voltage of the switch 142 implemented as a transistor. However, the predetermined first reference voltage is not limited thereto. For example, while the predetermined reference voltage can be 0.4 V, the predetermined reference voltage is not limited thereto.

To drive the serially connected light-emitting element arrays, a first voltage corresponding to the sum of rated operating voltages of the light-emitting element arrays may be applied across both terminals of the light-emitting element arrays.

When a function temperature of the light-emitting element arrays increases, operating voltages of the light-emitting element arrays may decrease. Such operating voltage decreases in the light-emitting element arrays cause a difference between the first voltage and an operating voltage actually applied across both terminals of the light-emitting element arrays. This voltage difference can result in generation of heat by other elements of the light-emitting element driving device, resulting in power efficiency reduction in the lighting apparatus.

It is possible to prevent power consumption wasted as heat in the switch 142 by decreasing the level of the DC signal VR2 provided to the light-emitting unit 101 on the basis of a result obtained by sensing the voltage across the switch 142 according to the present embodiment.

Since the dimming unit 140 senses the difference between the first sensing voltage Vsen1 and the second sensing voltage Vsen2 and adjusts the level of the DC signal VR2 provided to the light-emitting unit 101 such that the difference Vsen1-Vsen2 between the first and second sensing voltages is maintained as a predetermined voltage according to the sensing result, power consumed by the switch 142 can remain uniform even when the operating voltage of the light-emitting unit 101 is changed and power efficiency reduction in the lighting apparatus 100 can be prevented.

If the dimming controller 140 does not perform the aforementioned control operation, the difference between the voltage supplied from the voltage generator 130 and the voltage actually applied to the light-emitting unit 101 can be consumed as heat in the switch 142 due to operating voltage reduction in the light-emitting unit 101, and thus power efficiency of the lighting apparatus 100 can be reduced.

The controller 148 may turn off the light-emitting unit 101 by preventing the voltage generator 130 from providing the DC signal VR2 to the light-emitting unit 101 when the difference Vsen1-Vsen2 between the first sensing voltage Vsen1 and the second sensing voltage Vsen2 exceeds the second reference voltage.

Alternatively, the controller 148 may set or change the level of the constant-current control signal Vset to zero when the difference Vsen1-Vsen2 between the first sensing voltage Vsen1 and the second sensing voltage Vsen2 exceeds the second reference voltage.

When the difference Vsen1-Vsen2 between the first sensing voltage Vsen1 and the second sensing voltage Vsen2 exceeds the second reference voltage, the controller 148 needs to prevent current from flowing through the light-emitting unit for protecting the light-emitting unit 101 upon determining that short-circuit is generated in the light-emitting unit 101. To this end, the controller 148 may block provision of the DC signal VR2 or change the level of the constant-current control signal Vset to 0.

Figure 3:
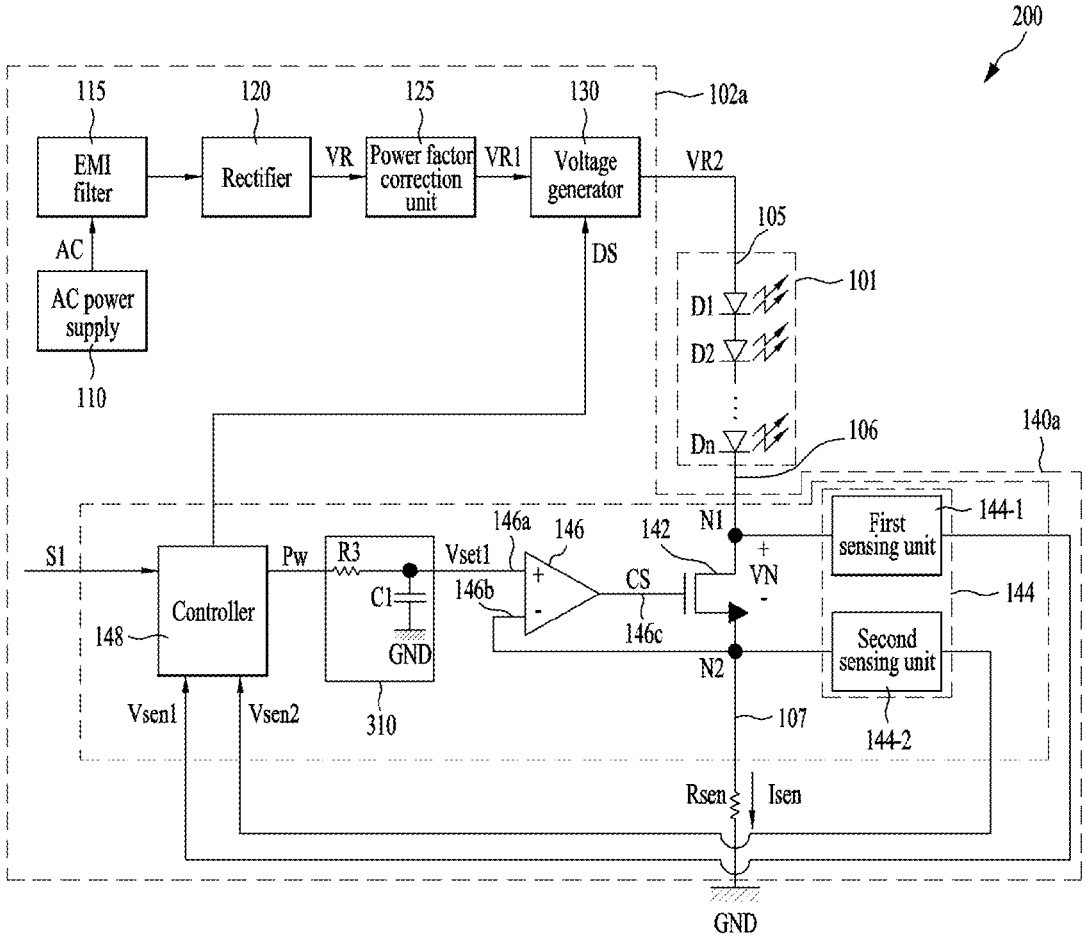
FIG. 3 illustrates a configuration of a lighting apparatus according to another embodiment.

FIG. 3 illustrates a configuration of the lighting apparatus 100 according to another embodiment. The same reference numbers will be used in FIGS. 1 and 3 to refer to the same or like parts, and a repeated description thereof will be simplified or omitted.

Referring to FIG. 3, the lighting apparatus 200 includes the light-emitting unit 101 and a light-emitting element driving device 102*a* for driving the light-emitting unit 101.

The light-emitting element driving unit 102*a* includes the AC power supply 110, the EMI filter 115, the rectifier 120, the power factor correction unit 125, the power generator 130, a dimming unit 140*a* and the sensing resistor Rsen.

The dimming unit 140*a* may include the switch 142, the voltage sensing unit 144, the amplifier 146, a smoothing circuit 310 and the controller 148.

The dimming unit 140*a* illustrated in FIG. 3 may further include the smoothing circuit 310 in addition to the dimming unit 140 shown in FIG. 1.

The smoothing circuit 310 smooths a signal Pw supplied form the controller 148 and outputs a constant-current control signal Vset1 according to the smoothing result.

The signal Pw supplied from the controller 148 may be a pulse width modulation (PWM) signal. When constant current control for the light-emitting unit 101 is performed on the basis of the duty ratio of such a PWM signal, current flowing through the light-emitting unit 101 has a ripple component and thus flickering may occur in the light-emitting unit 101 due to the ripple component.

The smoothing circuit 310 smooths the PWM signal supplied from the controller 148 in order to remove such flickering and generates the constant-current control signal Vset1 that is a DC analog signal from which a ripple current component has been removed according to the smoothing result.

The ripple component of the current flowing through the light-emitting unit 101 can be reduced by the constant-current control signal Vset1 generated by the smoothing circuit 310. The present embodiment can perform constant current control with respect to the light-emitting unit 101 using the level of the constant-current control signal Vset1 corresponding to an analog signal instead of the duty ratio of a PWM signal to thereby reduce or remove flickering of the light-emitting unit 101.

While the smoothing circuit 310 may be implemented as an RC smoothing circuit including a resistor R3 connected between the controller 148 and a first input terminal 146*a* of the amplifier 146 and a capacitor C1 connected between the first input terminal 146*a* of the amplifier 146 and the ground power supply GND, the smoothing circuit 310 is not limited thereto and may be implemented in various forms including a resistor, a capacitor or an inductor.

Figure 7A:
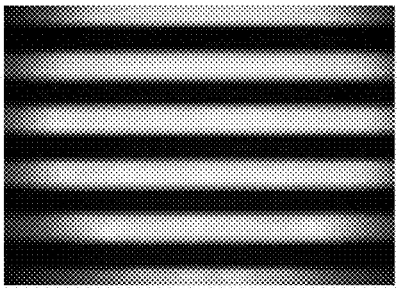
FIG. 7*a* illustrates light emission of a light-emitting unit when constant current control is performed using a duty ratio of a PWM signal.
Figure 7B:
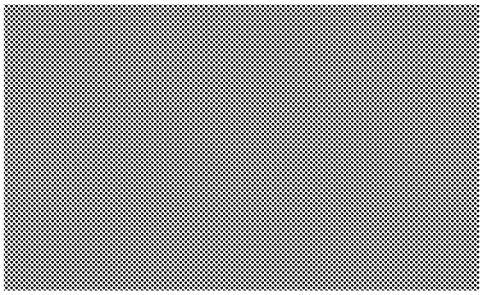
FIG. 7*b* illustrates light emission of a light-emitting unit according to an embodiment.

FIG. 7*a* illustrates light emission of a light-emitting unit when dimming control is performed using the duty ratio of a PWM signal and FIG. 7*b* illustrates light emission of the light-emitting unit 101 according to an embodiment.

Flickering is generated due to a contrast difference in light emission of the light-emitting unit illustrated in FIG. 7*a*. Conversely, there is little contrast difference and flickering in light emission of the light-emitting unit illustrated in FIG. 7*b*.

The present embodiment can adjust a dimming range up to 1% of maximum current that can flow through the light-emitting unit 101 because flickering is not generated even at low illumination, thereby reducing energy consumption.

According to the present embodiment, accurate current control can be performed because the current flowing through the light-emitting unit 101 or the luminance of the light-emitting unit 101 is controlled by adjusting the DC level of the constant-current control signal Vset1.

Figure 5:
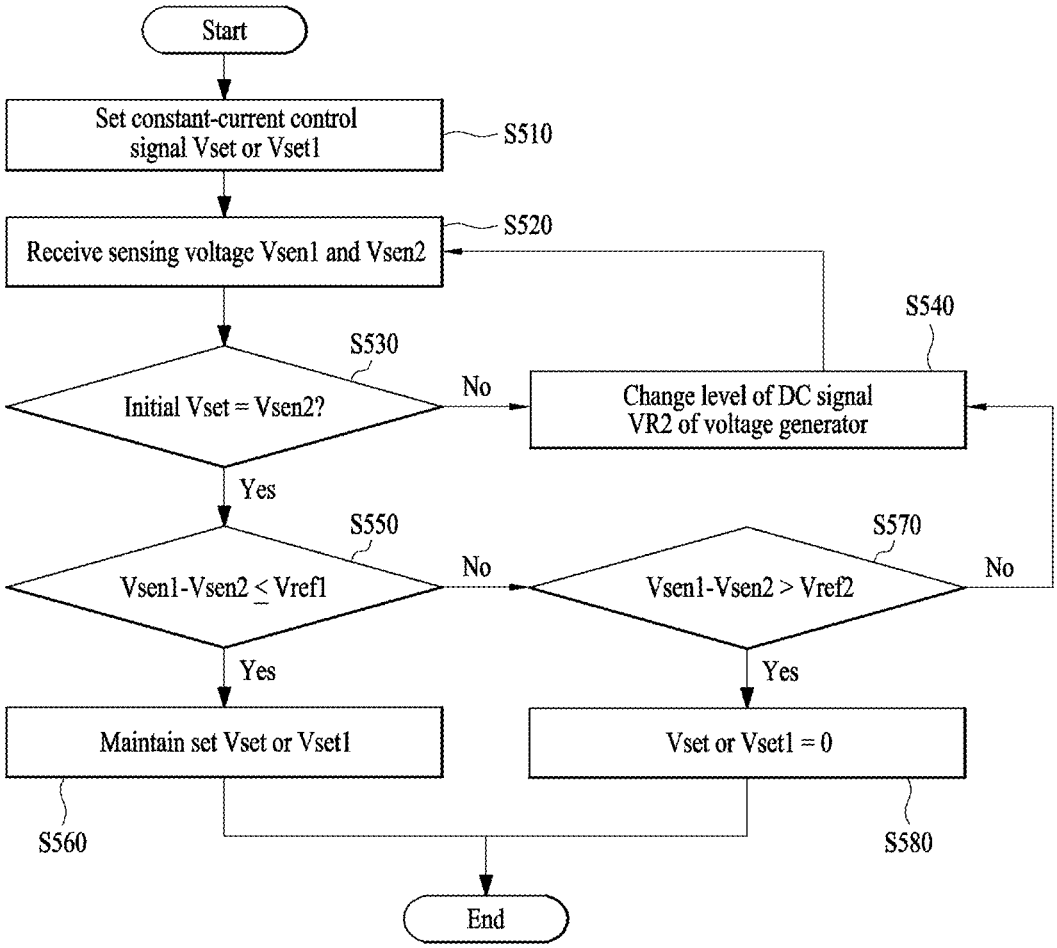
FIG. 5 is a flowchart illustrating an operation of a controller to control the level of a DC voltage supplied from a voltage generator to a light-emitting unit shown in FIGS. 1 and 3.

FIG. 5 is a flowchart illustrating the operation of the controller 148 to control the level of the DC voltage VR2 supplied from the voltage generator 130 to the light-emitting unit 101 shown in FIG. 3.

Referring to FIG. 5, the controller 148 sets the constant-current control signal Vset1 supplied to the first input terminal 146*a* of the amplifier 146 using an external signal S1 (refer to FIG. 3) received through a communication interface (S510). For example, the level of the analog signal may be a target to be set with respect to Vset of FIG. 1 and the duty ratio of the PWM signal may be a target to be set with respect to Vset1 of FIG. 3. The constant-current control signal Vset or Vset1 that determines the luminance of the light-emitting unit 101 may be set according to user selection. For example, a dimming degree may be determined in S510.

For example, the controller 148 can output a pulse width modulation signal Pw corresponding to the signal S1 received from the outside and the signal Pw provided by the controller 148 can be converted into the constant-current control signal Vset1 corresponding to an analog signal, as shown in FIG. 3. The level of the constant-current control signal Vset1 can be determined by the duty ratio of the signal Pw supplied from the controller 148. For example, the level of the constant-current control signal Vset1 can be proportional to the duty ratio of the signal Pw supplied from the controller 148.

Then, the controller 148 receives the first and second sensing voltages Vsen1 and Vsen2 supplied from the voltage sensing unit 144 (S520).

Subsequently, the controller 148 compares the set constant-current control signal Vset or Vset1 with the second sensing voltage Vsen2 in order to determine whether the voltage Vsen2 actually applied to the sensing resistor Rsen due to the current which flows through the light-emitting unit 101 according to the DC signal VR2 supplied from the voltage generator 130 is identical to the set constant-current control signal Vset or Vset1 (S530).

When the second sensing voltage Vsen2 is not identical to the set constant-current control signal Vset or Vset1, the controller 148 changes the level of the DC signal VR2 supplied from the voltage generator 130 to the light-emitting unit 101 (S540). The controller 148 may repeatedly perform steps S520 to S540 until the second sensing voltage Vsen2 becomes identical to the set constant-current control signal Vset or Vset1.

For example, the second sensing voltage Vsen2 may be lower than the set constant-current control signal Vset or Vset1. In this case, the controller 148 can change the level of the DC signal VR2 until the set constant-current signal Vset or Vset1 becomes the second sensing voltage Vsen2.

On the contrary, when the second sensing voltage Vsen2 is identical to the set constant-current control signal Vset or Vset1, the controller 148 determines whether the difference Vsen1-Vsen2 between the received first sensing voltage Vsen1 and second voltage Vsen2 is equal to or lower than the predetermined first reference voltage Vref1 (S550).

For example, the predetermined first reference voltage Vref1 may be a drain-source on state voltage of the switch 142 implemented as a transistor. For example, the predetermined first reference voltage Vref1 can be 0.4 V. However, the first reference voltage Vref1 is not limited thereto.

When the difference Vsen1-Vsen2 between the received first sensing voltage Vsen1 and second voltage Vsen2 is equal to or lower than the predetermined first reference voltage Vref1, the controller 148 does not change the level of the DC signal VR2 and maintains the set constant-current control signal Vset or Vset1 (S560).

The fact that the difference Vsen1-Vsen2 between the received first sensing voltage Vsen1 and second voltage Vsen2 is equal to or lower than the predetermined first reference voltage Vref1 means that there is no or little power wasted as heat in the switch 142, and thus the controller 148 does not change the level of the DC signal VR2. The opposite case means that lots of power is wasted as heat in the switch 142, and thus the controller 148 reduces the level of the DC signal VR2.

When the difference Vsen1-Vsen2 between the received first sensing voltage Vsen1 and second voltage Vsen2 exceeds the predetermined first reference voltage Vref1, the controller 148 determines whether the difference Vsen1-Vsen2 between the received first sensing voltage Vsen1 and second voltage Vsen2 exceeds the second reference voltage Vref2 (S570). The second reference voltage Vref2 is higher than the first reference voltage Vref1 (Vref2>Vref1).

The second reference signal Vref2 may be a voltage by which the light-emitting unit 101 is determined to short-circuit. For example, the second reference voltage Vref2 can be 3.5 V. However, the second reference voltage Vref2 is not limited thereto.

When the difference Vsen1-Vsen2 between the received first sensing voltage Vsen1 and second voltage Vsen2 exceeds the predetermined first reference voltage Vref1 and is equal to or lower than the second reference voltage Vref2 (Vref1<Vsen1-Vsen2≤Vref2), the controller 148 changes the level of the DC signal VR2 supplied from the voltage generator 130 to the light-emitting unit 101 (S550→S570→S540).

The controller 149 repeatedly performs steps S520, S530, S550, S570 and S540 until the difference Vsen1-Vsen2 between the received first sensing voltage Vsen1 and second voltage Vsen2 becomes equal to or lower than the first reference voltage Vref1. For example, the controller 148 can control the difference Vsen1-Vsen2 between the received first sensing voltage Vsen1 and second voltage Vsen2 to be equal to or lower than the first reference voltage Vref1 by decreasing the level of the DC signal VR2 supplied from the voltage generator 130 to the light-emitting unit 101.

For example, when the junction temperature of the light-emitting unit 101 increases and thus the driving voltage of the light-emitting unit 101 decreases, the difference Vsen1-Vsen2 between the received first sensing voltage Vsen1 and second voltage Vsen2 increases. When the difference Vsen1-Vsen2 between the received first sensing voltage Vsen1 and second voltage Vsen2 increases to be equal to or lower than the second reference voltage Vref2 while exceeding the first reference voltage Vref1, the controller 148 can decrease the level of the DC signal VR2 to improve power efficiency.

When the difference Vsen1-Vsen2 between the received first sensing voltage Vsen1 and second voltage Vsen2 exceeds the second reference signal Vref2 (Vsen1-Vsen2>Vref2), the controller 148 can change the level of the set constant-current control signal Vset or Vset1 to zero.

When the difference Vsen1-Vsen2 between the received first sensing voltage Vsen1 and second voltage Vsen2 exceeds the second reference signal Vref2, the controller 148 can change the level of the constant-current control signal Vset or Vset1 to 0 such that current does not flow through the light-emitting unit 101 in order to protect the light-emitting unit 101 and the light-emitting element driving device 102 upon determining that short-circuit is generated in the light-emitting unit 101.

Figure 4:
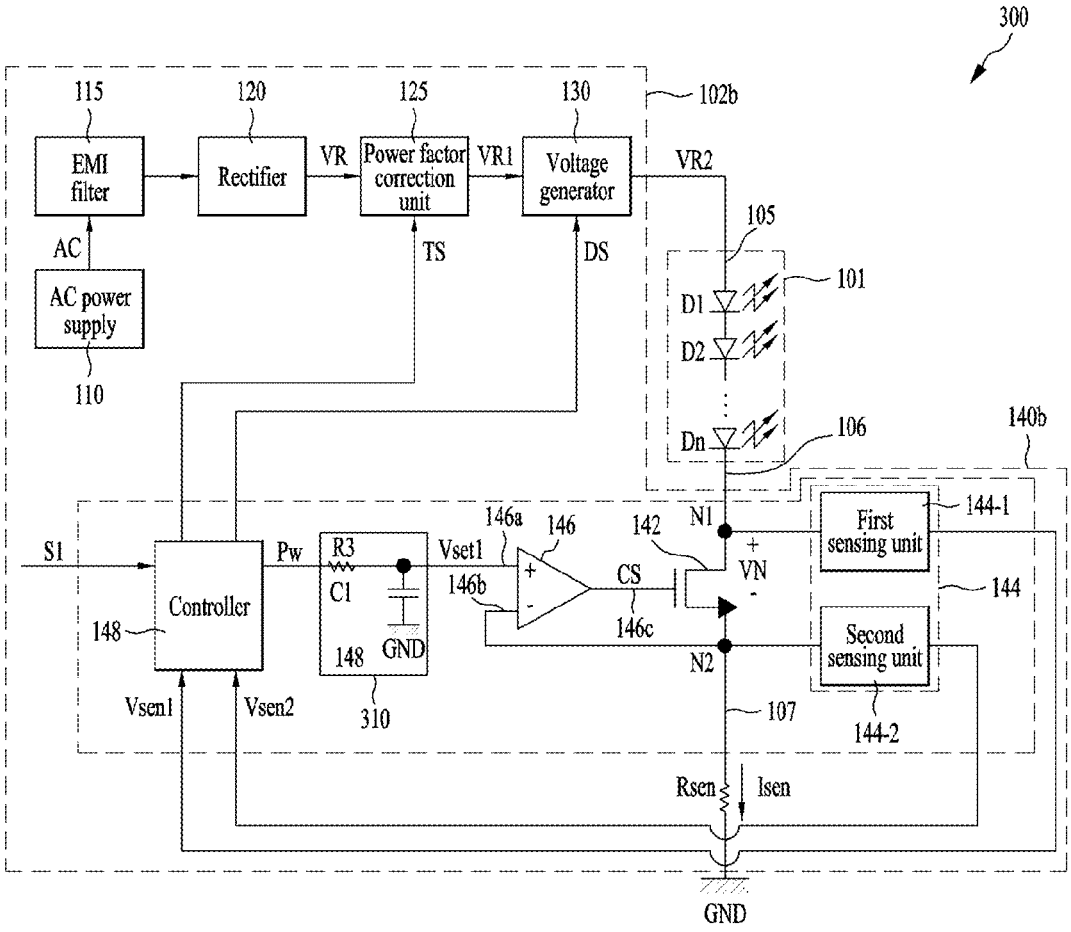
FIG. 4 illustrates a configuration of a lighting apparatus according to another embodiment.

FIG. 4 illustrates a configuration of a lighting apparatus 300 according to another embodiment. The same reference numbers will be used in FIGS. 1 and 4 to refer to the same or like parts, and a repeated description thereof will be simplified or omitted.

Referring to FIG. 4, the lighting apparatus 300 includes a light-emitting unit 101 and a light-emitting element driving device 102*b* for driving the light-emitting unit 101.

The light-emitting element driving device 102*b* includes the AC power supply 110, the EMI filter 115, the rectifier 120, the power factor correction unit 125, the power generator 130, a dimming unit 140*b* and the sensing resistor Rsen.

The dimming unit 140*b* may include the switch 142, the voltage sensing unit 144, the amplifier 146, the smoothing circuit 310 and a controller 148-1.

The controller 148-1 outputs the dimming signal DS for controlling the voltage generator 130 and a PFC control signal TS for controlling the power factor correction unit 125.

Description of the dimming signal DS is identical to description with reference to FIG. 1 and thus is omitted to avoid redundant description.

The controller 148-1 calculates sensing current Isen flowing through the sensing resistor Rsen on the basis of the second sensing voltage Vsen2 supplied from the second sensing unit 144-2 and turns on or off the power factor correction unit 125 on the basis of the calculated sensing current Isen.

Figure 6:
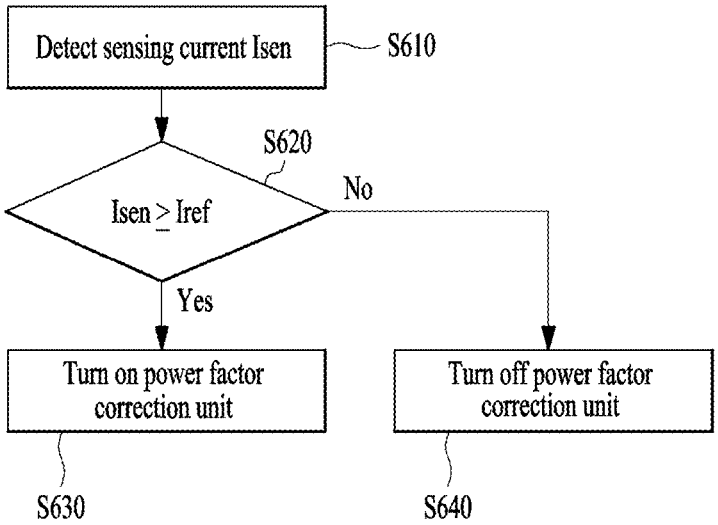
FIG. 6 is a flowchart illustrating an operation of the controller to control a power factor correction unit of FIG. 4.

FIG. 6 is a flowchart illustrating an operation of the controller 148-1 to control the power factor correction unit 125 of FIG. 4.

Referring to FIG. 6, the controller 148-1 detects the sensing current Isen flowing through the sensing resistor Rsen on the basis of the second sensing voltage Vsen2 supplied from the second sensing unit 144-2 (S610).

The controller 148-1 can store the value of the sensing resistor Rsen and calculate the sensing current Isen by dividing the second sensing voltage Vsen2 received from the second sensing unit 144-2 by the stored value of the sensing resistor Rsen.

Then, the controller 148-1 determines whether the value of the detected sensing current Isen is equal to or greater than a predetermined reference current value Iref (S620). For example, the current flowing through the light-emitting unit 101 can be controlled by the constant-current control signal Vset or Vset1 supplied from the controller 148, and the predetermined reference current value Iref may be 20% to 50% of maximum current that can flow through the light-emitting unit 101 in response to the constant-current control signal Vset or Vset1.

For example, the predetermined reference current value Iref can be 20% of the maximum current that can flow through the light-emitting unit 101 in response to the maximum constant-current control signal Vset or Vset1.

Then, when the value of the detected sensing current Isen is lower than the predetermined reference current value Iref, the controller 148-1 turns off the power factor correction unit 125 such that the power factor correction unit 125 does not operate. That is, when the value of the detected sensing current Isen is lower than the predetermined reference current value Iref, the controller 148-1 turns off the power factor correction unit 125 such that power is not consumed by the power factor correction unit 125.

On the other hand, when the value of the detected sensing current Isen is equal to or greater than the predetermined reference current value Iref, the controller 148-1 turns on the power factor correction unit 125 such that the power factor correction unit 125 performs an operation. For example, the controller 148-1 can turn off or on the power factor correction unit 125 by blocking power provided to the power factor correction unit 125 or supplying power to the power factor correction unit 125 using the PFC control signal TS. However, embodiments are not limited thereto.

In a period in which the current flowing through the light-emitting unit 101 is lower than the reference current value Iref, power factor improvement is insufficient even if power factor correction is performed. Accordingly, the present embodiment can prevent the power factor correction unit 125 from consuming power by turning off the power factor correction unit 125 in the period in which the current flowing through the light-emitting unit 101 is lower than the reference current value Iref, thereby improving power efficiency.

Furthermore, the present embodiment can secure an EMI (Electromagnetic Interference) margin by suspending the operation of the power factor correction unit 125 in a period in which power factor correction is not needed in order to reduce EMI.

Figure 8:
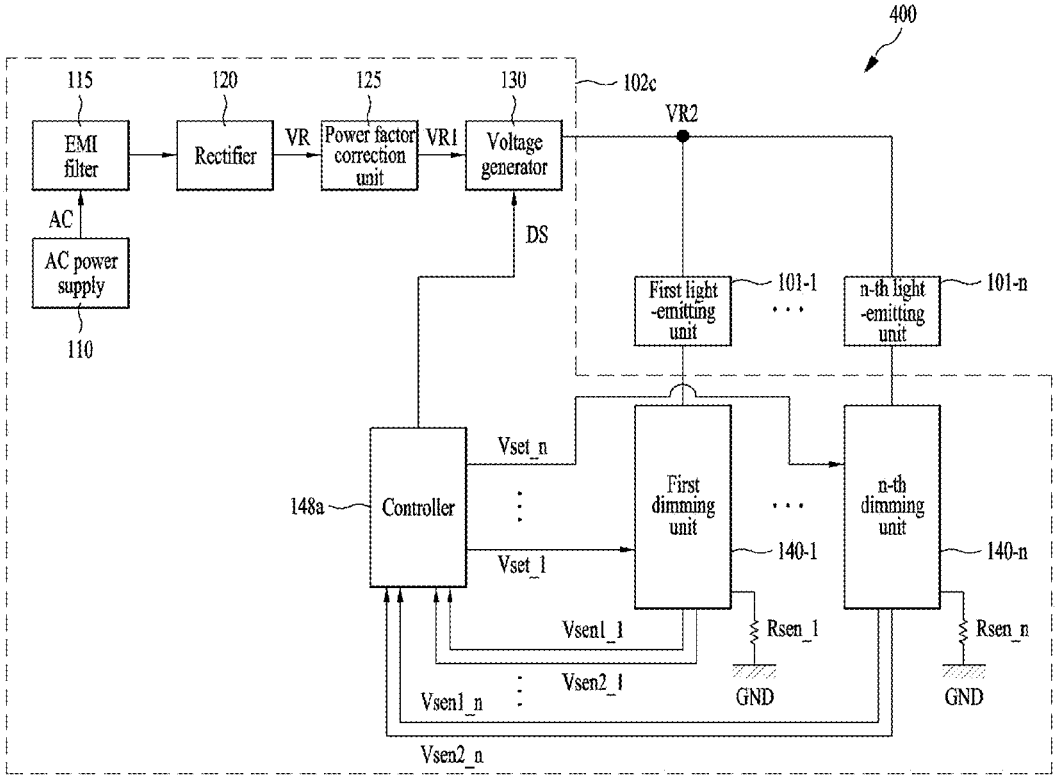
FIG. 8 illustrates a configuration of a lighting apparatus according to another embodiment.

FIG. 8 illustrates a configuration of a lighting apparatus 400 according to another embodiment. The same reference numbers will be used in FIGS. 1, 3 and 8 to refer to the same or like parts, and a repeated description thereof will be simplified or omitted.

Referring to FIG. 8, the lighting apparatus 400 includes a plurality of light-emitting units 101-1 to **101-*n* (n being a natural number greater than 1) and a light-emitting element driving device 102*c* for driving the plurality of light-emitting units 101-1 to 101-*n*** (n being a natural number greater than 1).

Each of the plurality of light-emitting units 101-1 to **101-*n* (n being a natural number greater than n) may be implemented to be identical to the light-emitting unit 101 described with reference to FIG. 1** and description thereof is omitted to avoid redundant description.

The light-emitting element driving device **102*c* includes the AC power supply 110, the EMI filter 115, the rectifier 120, the power factor correction unit 125, the power generator 130, a plurality of dimming units 140-1 to 140-*n* (n being a natural number greater than 1), a plurality of sensing resistors Rsen_1 to Rsen_n (n being a natural number greater than 1) and a controller 148*a***.

The AC power supply 110, the EMI filter 115, the rectifier 120, the power factor correction unit 125 and the power generator 130 of the light-emitting element driving device **102*c* may be identical to those described with reference to FIGS. 1 and 3. The DC signal VR2 output from the voltage generator 130 is simultaneously provided to the plurality of dimming units 140-1 to 140-*n*** (n being a natural number greater than 1).

Each of the plurality of dimming units 140-1 to **140-*n* (n being a natural number greater than 1) may include: an amplifier 146 having a first input terminal to which a corresponding one of constant-current control signals Vset1 to Vset_n (n being a natural number greater than 1) is input, a second input terminal connected to a corresponding one of the plurality of sensing resistors Rsen_1 to Rsen_n (n being a natural number greater than 1), and an output terminal; a switch 142 connected between a corresponding one of the plurality of light-emitting units 101-1 to 101-*n* (n being a natural number greater than 1) and one terminal of a corresponding one of the plurality of sensing resistors Rsen_1 to Rsen_n (n being a natural number greater than 1) and switched in response to the output of the amplifier 146; and a voltage sensing unit 144 outputting first sensing voltages Vsen1_1 to Vsen1**_*n* (n being a natural number greater than 1) according to results obtained by sensing a voltage of the first node N1 at which a corresponding one of the plurality of light-emitting units 101-1 to **101-*n* (n being a natural number greater than 1) and the switch 142 are connected and second sensing voltages Vsen2_1 to Vsen2**_*n* (n being a natural number greater than 1) according to results obtained by sensing a voltage of the second node N2 at which the switch 142 and one terminal of a corresponding one of the plurality of sensing resistors Rsen_1 to Rsen_n (n being a natural number greater than 1) are connected.

The controller **148*a* may adjust the level of the DC signal VR2 on the basis of the differences Vsen1_1-Vsen2_1 to Vsen1**_*n*-Vsen2_*n* between the first sensing voltages and the second sensing voltages.

The plurality of dimming units 140-1 to **140-*n* (n being a natural number greater than 1) connects corresponding light-emitting units 101-1 to 101-*n* (n being a natural number greater than 1) to corresponding sensing resistors Rsen_1 to Rsen_n (n being a natural number greater than 1) and controls luminance of the plurality of light-emitting units 101-1 to 101-*n* (n being a natural number greater than 1) by adjusting current flowing through the plurality of light-emitting units 101-1 to 101-*n*** (n being a natural number greater than 1).

Each of the dimming units 140-1 to **140-*n* (n being a natural number greater than 1) may include the switch 142, the voltage sensing unit 144 and the amplifier 146. Description of the switch 142, the voltage sensing unit 144 and the amplifier 146 of FIG. 1 may be equally applied to the plurality of dimming units 140-1 to 140-*n*** (n being a natural number greater than 1).

In another embodiment, each of the plurality of dimming units 140-1 to **140-*n* (n being a natural number greater than 1) may further include the smoothing circuit 310 shown in FIG. 3**.

The switch 142 of each of the plurality of dimming units 140-1 to **140-*n* (n being a natural number greater than 1) may be connected between the output terminal 106 of a corresponding one of the plurality of light-emitting units 101-1 to 101-*n* (n being a natural number greater than 1) and a corresponding one of the plurality of sensing resistors Rsen_1 to Rsen_n (n being a natural number greater than 1) and may be switched on the basis of a corresponding one of the constant-current control signals Vset_1 to Vset_n (n being a natural number greater than 1) supplied from the controller 148*a***.

The plurality of dimming units 140-1 to **140-*n* (n being a natural number greater than 1) can output the first sensing voltages Vsen1_1 to Vsen1**_*n* (n being a natural number greater than 1) according to a result obtained by sensing the voltage of the first node N1 and the second sensing voltages Vsen2_1 to Vsen2_*n* (n being a natural number greater than 1) according to a result obtained by sensing the voltage of the second node N1.

The controller **158*a* provides the constant-current control signals Vset_1 to Vset_n (n being a natural number greater than 1) for dimming to the plurality of dimming units 140-1 to 140-*n*** (n being a natural number greater than 1).

The controller **148*a* may control the voltage generator 130 to change the level of the DC signal VR2 output from the voltage generator 130 on the basis of the differences Vsen1_1-Vsen2_1 to Vsen1**_*n*-Vsen2_*n* between the first sensing voltages Vsen1_1 to Vsen1_*n* (n being a natural number greater than 1) and the second sensing voltages Vsen2_1 to Vsen2_*n* (n being a natural number greater than 1).

For example, the controller **148*a* can calculate the differences Vsen1_1-Vsen2_1 to Vsen1**_*n*-Vsen2_*n* between the first sensing voltages Vsen1_1 to Vsen1_*n* (n being a natural number greater than 1) and the second sensing voltages Vsen2_1 to Vsen2_*n* (n being a natural number greater than 1) supplied from the plurality of dimming units 140-1 to **140-*n* (n being a natural number greater than 1) and set a first reference value and a second reference value on the basis of the calculated differences Vsen1_1-Vsen2_1 to Vsen1**_*n*-Vsen2_*n* between the first sensing voltages and the second sensing voltages.

The controller **148*a* may decrease the level of the DC signal VR2 supplied from the voltage generator 130** by the first reference value.

The first reference value may be a value obtained by subtracting a predetermined first reference voltage from the largest value among the calculated differences Vsen1_1-Vsen2_1 to Vsen1_*n*-Vsen2_*n* between the first sensing voltages and the second sensing voltages. Here, the predetermined first reference voltage may be a drain-source on state voltage of the switch 142 implemented as a transistor.

Operating voltages of the light-emitting units 101-1 to **101-*n* (n being a natural number greater than 1) may decrease due to a junction temperature increase in the light-emitting element arrays and dimming according to variations in the constant-current control signals Vset_1 to Vset_n. Here, operating voltage reductions in the light-emitting units 101-1 to 101-*n* (n being a natural number greater than 1) may be different and power losses as heat in the plurality of dimming units 140-1 to 140-*n*** (n being a natural number greater than 1) in response to the operating voltage reductions may be different.

When the operating voltages of the light-emitting units 101-1 to **101-*n* (n being a natural number greater than 1) decrease, the present embodiment reduces the level of the DC signal VR2 supplied from the voltage generator 130 by the first reference value to meet desired luminance levels (e.g., luminance levels of 100% or 50%) of all light-emitting elements 101-1 to 101-*n*** (n being a natural number greater than 1) and to improve power efficiency.

Furthermore, the controller **148*a* may reduce the level of the DC signal VR2 supplied from the voltage generator 130** by the sum of the first reference value and the second reference value, for example.

The second reference value may be less than the difference between the largest value and the smallest value from among the differences Vsen1_1-Vsen2_1 to Vsen1_*n*-Vsen2_*n* of the calculated first and second voltages.

For example, the second reference value may be half the difference between the largest value and the smallest value from among the differences Vsen1_1-Vsen2_1 to Vsen1_*n*-Vsen2_*n* of the calculated first and second voltages. However, the second reference value is not limited thereto.

Here, the second reference value is subtracted from the level of the DC voltage VR2 in order to further improve power efficiency even if some of the light-emitting units 101-1 to **101-*n*** (n being a natural number greater than 1) cannot satisfy desired luminance levels (e.g., luminance level of 100% or 50%).

As described above, the present embodiment can improve power efficiency by reducing the level of the DC signal VR2 commonly provided to the plurality of light-emitting units 101-1 to **101-*n* (n being a natural number greater than 1) in response to operating voltage variations in the plurality of light-emitting units 101-1 to 101-*n*** (n being a natural number greater than 1).

The detailed description of the preferred embodiments of the present invention has been given to enable those skilled in the art to implement and practice the invention. Although the invention has been described with reference to the preferred embodiments, those skilled in the art will appreciate that various modifications and variations can be made in the present invention without departing from the spirit or scope of the invention described in the appended claims. Accordingly, the invention should not be limited to the specific embodiments described herein, but should be accorded the broadest scope consistent with the principles and novel features disclosed herein.

INDUSTRIAL APPLICABILITY

The present invention is used for a light-emitting element driving device capable of improving power efficiency and preventing flickering.

The invention claimed is:

1. A device for driving a light-emitting element, comprising:

a voltage generator providing a DC signal for driving a light-emitting unit;

a sensing resistor; and a dimming unit controlling current flowing through the sensing resistor and the light-emitting unit, wherein the dimming unit comprises:

a switch connected between the light-emitting unit and the sensing resistor, and switched in response to a constant-current control signal;

a first voltage sensing unit outputting a first sensing voltage according to a result obtained by sensing a voltage of a first node at which the light-emitting unit and the switch are connected;

a second voltage sensing unit outputting a second sensing voltage according to a result obtained by sensing a voltage of a second node at which the switch and one terminal of the sensing resistor are connected; and a controller providing the constant-current control signal and adjusting a level of the DC signal based on a difference the first sensing voltage and the second sensing voltage, wherein the controller receives the first sensing voltage and the second sensing voltage, and adjusts the level of the DC signal such that the difference between the first sensing voltage and the second sensing voltage becomes equal to or lower than a first reference voltage, and wherein the switch is implemented as a transistor and the first reference voltage is a drain-source on state voltage of the switch.

2. The device for driving a light-emitting element according to claim 1, wherein the controller blocks current flow between the light-emitting unit and the sensing resistor when the difference between the first sensing voltage and the second sensing voltage exceeds a second reference voltage, and wherein the second reference voltage is greater than the first reference voltage.

3. The device for driving a light-emitting element according to claim 1, wherein the dimming unit further comprises:

an amplifier including a first input terminal receiving the constant-current control signal, a second input terminal connected to the second node, and an output terminal, wherein the controller generates a dimming signal based on the difference between the first sensing voltage and the second sensing voltage, and wherein the switch is switched in response to an output from the output terminal of the amplifier and the voltage generator adjusts the level of the DC signal based on the dimming signal.

4. The device for driving a light-emitting element according to claim 3, wherein the constant-current control signal is an analog signal.

5. The device for driving a light-emitting element according to claim 3, wherein the controller smooths a pulse width modulation signal and provides a signal according to a smoothing result as the constant-current control signal.

6. The device for driving a light-emitting element according to claim 3, wherein the controller decreases the level of the DC signal when the difference between the first sensing voltage and the second sensing voltage exceeds the first reference voltage and is equal to or lower than a second reference voltage, and wherein the second reference voltage is greater than the first reference voltage.

7. The device for driving a light-emitting element according to claim 3, wherein the controller changes a level of the constant-current control signal to zero when the difference between the first sensing voltage and the second sensing voltage exceeds a second reference voltage, and wherein the second reference voltage is greater than the first reference voltage.

8. The device for driving a light-emitting element according to claim 3, further comprising:

a rectifier for rectifying an AC signal and providing a rectified signal according to the rectification result; and a power factor correction unit for correcting a power factor of the rectified signal and outputting the power-factor-corrected rectified signal to the voltage generator.

9. The device for driving a light-emitting element according to claim 8, wherein the controller calculates sensing current flowing through the sensing resistor based on the second sensing voltage and turns on or off the power factor correction unit based on the calculated sensing current.

10. The device for driving a light-emitting element according to claim 9, wherein the controller turns off the power factor correction unit when the sensing current is lower than a reference current value.

11. The device for driving a light-emitting element according to claim 1, wherein when the difference between the first sensing voltage and the second sensing voltage exceeds the first reference voltage, the controller decreases the DC signal for driving the light-emitting unit until the difference between the first sensing voltage and the second sensing voltage becomes equal to or lower than the first reference voltage.

12. A device for driving a light-emitting element, comprising:

a voltage generator providing a DC signal for driving a light-emitting unit based on a dimming signal;

an amplifier including a first input terminal receiving a constant-current control signal, a second input terminal and an output terminal;

a sensing resistor, one terminal of which is connected to the second input terminal of the amplifier;

a transistor including a source and a drain connected between the light-emitting unit and the sensing resistor and a gate, wherein an output of the output terminal of the amplifier is provided to the gate of the transistor;

a voltage sensing unit outputting a first sensing voltage according to a result obtained by sensing a voltage of a first node at which the light-emitting unit and the transistor are connected and a second sensing voltage according to a result obtained by sensing a voltage of a second node at which the transistor and one terminal of the sensing resistor are connected; and a controller providing the constant-current control signal and providing the dimming signal for adjusting a level of the DC signal based on a difference between the first sensing voltage and the second sensing voltage to the voltage generator, wherein the controller receives the first sensing voltage and the second sensing voltage, and adjusts the level of the DC signal such that a difference between the first sensing voltage and the second sensing voltage becomes equal to or lower than a first reference voltage, and wherein the first reference voltage is a drain-source on state voltage of the transistor.

13. The device for driving a light-emitting element according to claim 12, further comprising a smoothing circuit for smoothing a pulse width modulation signal and providing a signal according to the smoothing result as the constant-current control signal.

14. The device for driving a light-emitting element according to claim 13, wherein the controller provides the pulse width modulation signal.

15. The device for driving a light-emitting element according to claim 13, further comprising:

a rectifier for rectifying an AC signal and providing a rectified signal according to the rectification result; and a power factor correction unit for correcting a power factor of the rectified signal and outputting the power-factor-corrected rectified signal to the voltage generator.

16. The device for driving a light-emitting element according to claim 15, wherein the voltage generator changes the level of the power-factor-corrected rectified signal based on the dimming signal and generates the DC signal according to the level change result.

17. The device for driving a light-emitting element according to claim 15, wherein the controller calculates sensing current flowing through the sensing resistor based on the second sensing voltage and turns on or off the power factor correction unit based on the calculated sensing current.

18. The device for driving a light-emitting element according to claim 12, wherein when the difference between the first sensing voltage and the second sensing voltage exceeds the first reference voltage, the controller decreases the DC signal for driving the light-emitting unit until the difference between the first sensing voltage and the second sensing voltage becomes equal to or lower than the first reference voltage.

19. A device for driving a light-emitting element, comprising:

a voltage generator providing a DC signal for driving a plurality of light-emitting units;

a plurality of sensing resistors;

a plurality of dimming units controlling current flowing through the plurality of light-emitting units; and a controller providing a constant-current control signal to each of the plurality of dimming units, wherein each of the plurality of dimming units comprises:

an amplifier including a first input terminal receiving the constant-current control signal, a second input terminal connected to a corresponding one of the plurality of sensing resistors, and an output terminal;

a switch connected between a corresponding one of the plurality of light-emitting units and one terminal of a corresponding one of the plurality of sensing resistors, and switched in response to the constant-current signal; and a voltage sensing unit outputting first sensing voltages according to results obtained by sensing a voltage of a first node at which a corresponding one of the plurality of light-emitting units and the switch are connected and second sensing voltages according to results obtained by sensing a voltage of a second node at which the switch and one terminal of a corresponding one of the plurality of sensing resistors are connected, wherein the controller adjust a level of the DC signal based on differences between the first sensing voltages and the second sensing voltages, wherein the controller receives the first sensing voltages and the second sensing voltages, and adjusts the level of the DC signal such that the differences between the first sensing voltages and the second sensing voltages become equal to or lower than a first reference voltage, and wherein the switch is implemented as a transistor and the first reference voltage is a drain-source on state voltage of the switch.

20. The device for driving a light-emitting element according to claim 19, wherein when the differences between the first sensing voltages and the second sensing voltages exceed the first reference voltage, the controller decreases the DC signal for driving the light-emitting unit until the differences between the first sensing voltages and the second sensing voltages become equal to or lower than the first reference voltage.

* * * * *